US009726465B1

(12) United States Patent
Moore

(10) Patent No.: US 9,726,465 B1
(45) Date of Patent: Aug. 8, 2017

(54) TIP FOR ARCHERY ARROWS

(71) Applicant: Kirby Moore, San Jose, CA (US)

(72) Inventor: Kirby Moore, San Jose, CA (US)

( * ) Notice: Subject to any disclaimer, the term of this patent is extended or adjusted under 35 U.S.C. 154(b) by 0 days.

(21) Appl. No.: 15/236,248

(22) Filed: Aug. 12, 2016

(51) Int. Cl.
*F42B 6/08* (2006.01)

(52) U.S. Cl.
CPC ..... *F42B 6/08* (2013.01)

(58) Field of Classification Search
CPC ..... F42B 6/02; F42B 6/04; F42B 6/08
USPC ..... 473/578, 582, 583
See application file for complete search history.

(56) References Cited

U.S. PATENT DOCUMENTS 3,012,786 A * 12/1961 Saunders ..... F42B 6/08 473/585
3,241,836 A * 3/1966 Zwickey ..... F42B 6/08 473/582
3,841,635 A * 10/1974 Wilson ..... F42B 6/003 248/205.5
4,396,196 A * 8/1983 Drennan ..... F42B 6/08 473/585
4,471,962 A * 9/1984 Godfrey ..... F42B 6/08 473/582
7,300,367 B1 * 11/2007 Andol ..... F42B 12/385 342/385
7,314,419 B2 * 1/2008 Grace ..... F42B 6/08 473/583
8,105,188 B1 * 1/2012 Mercer ..... F42B 6/08 473/583
8,192,310 B2 * 6/2012 Harris ..... F42B 6/08 473/582
8,852,038 B1 * 10/2014 Hyde ..... F42B 6/08 473/578
9,022,886 B2 * 5/2015 Faller ..... F42B 6/08 473/582
9,091,514 B1 * 7/2015 Cummings ..... F42B 6/02
2007/0026980 A1 * 2/2007 Grace ..... F42B 6/08 473/582
2011/0300975 A1 * 12/2011 Harris ..... F42B 6/08 473/582

(Continued)

OTHER PUBLICATIONS

Lancaster Archery Supply, retrieved at http://www.lancasterarchery.com/saunders-screw-in-bludgeon-100-gr.html on Jul. 13, 2016, 1 page.

(Continued)

*Primary Examiner* — Alexander Niconovich
(74) *Attorney, Agent, or Firm* — Christopher Peil; Law Office of Christopher Peil

(57) ABSTRACT

An aerodynamic tip for an archery arrow includes a nipple centered on the face of the tip and surrounded by projections at the outer diameter. Air striking the rounded ends of the projections is diverted toward the rounded end of the nipple. As the air is diverted by the nipple it flows into radial grooves along the side of the body of the tip, where it passes into the atmosphere, minimizing air resistance encountered by the tip as it traverses its flight path. On contact, the energy and mass is concentrated to the projections, causing immediate penetration of the target by the front portion of the tip, with the remainder of the tip following. After impact, the radial grooves channel blood away from the tip as it penetrates the flesh of the target, allowing the arrow to completely travel through the target, achieving a "through and through" shot.

14 Claims, 4 Drawing Sheets

(56) References Cited

U.S. PATENT DOCUMENTS

| | | | | |
|---|---|---|---|---|
| 2013/0065716 | A1* | 3/2013 | Pierce | A61L 9/12 473/581 |
| 2014/0256479 | A1* | 9/2014 | Bynum, Jr. | F42B 6/08 473/470 |

OTHER PUBLICATIONS

3 Rivers Archery, retrieved at http://www.3riversarchery.com/the-quothammertradequot-screw-in-small-game-blunt.html on Jul. 13, 2016, 1 page.

Lancaster Archery Supply, retrieved at http://www.lancasterarchery.com/pro-release-thumper-small-game-blunt.html on Jul. 13, 2016, 1 page.

* cited by examiner

TIP FOR ARCHERY ARROWS

BACKGROUND

Technical Field

The present disclosure generally relates to archery equipment. More particularly, the present disclosure relates to a tip for archery arrows.

Background Information

The primary functional part of an archery arrow is the arrowhead. Sport archers and modern bow hunters are accustomed to referring to arrowheads as "tips." The tip is attached to an arrow shaft to be shot from a bow. In modern archery arrows, the tip may be fastened to the arrow shaft by means of a tang that fits into a hole that is co-linear with the central longitudinal axis of the shaft.

There are a number of different tip types corresponding to the different uses for archery arrows. In hunting, for example, broadhead tips are sometimes used, particularly when hunting larger game animals such as deer. Field tips are used almost exclusively for practice. Because field tips are slender and pointed, they are able to traverse their flight path without generating a great deal of air resistance, striking their targets while conserving velocity and momentum due to their aerodynamic properties.

For hunting small game, blunt tips are often used. The functional objective of a blunt tip is to kill the target through blunt force trauma inflicted by the flat front of the blunt tip. A blunt tip may also be designed to penetrate the target, piercing and tearing soft tissues in its path.

Conventional blunt tips may flare out at the front portion to form a wider striking surface in order to deliver more shock to the target. The faces of some conventional blunt tips may exceed ½" in diameter. The shape and mass of most conventional tips is such that they tend to increase air resistance and decrease the amount of lift acting on the arrow as it traverses the flight path. Thus, while any arrow loses momentum and accelerates toward the earth during flight, this behavior may be amplified in arrows equipped with blunt tips. For this reason, the effectiveness of conventional blunt tips is highly dependent on the strength and skill of the archer. While blunt tips are effective when used by a sufficiently skilled archer, in the hands of an archer of less skill they frequently fall short of their target, or they may bounce off of the target. Even if they strike the target, they may not strike with sufficient momentum to inflict a lethal injury on the target.

An archer of sufficient skill and strength is able to compensate, at least partially, for the handicap imposed by the size and mass of the conventional blunt tip by launching the arrow toward its target with sufficient momentum and at an appropriately chosen launch angle so that the arrow hits its target with sufficient force to inflict lethal damage to the target. Archers having less skill often experience great frustration using arrows equipped with blunt tips.

Manufacturers have produced different types of blunt tip to compensate for some of the design flaws inherent to conventional blunt tips. Various surface features, for example have been added to the face of the tip, which are designed to minimize the possibility of the arrow bouncing off of the target, or to concentrate the impact of the tip. There are tips that have been provided with a cutting edge to increase the possibility of the tip inflicting lethal injury on the target and so on. However, none of the improvements to the tip, to date, address the suboptimal aerodynamic properties of the tip.

SUMMARY

An aerodynamic tip for an archery arrow includes a nipple centered on the face of the point and surrounded by projections at the outer diameter. Air striking the rounded ends of the projections is diverted toward the rounded end of the nipple. As the air is diverted by the nipple it flows into radial grooves along the side of the body of the tip, where it passes into the atmosphere, minimizing air resistance encountered by the point as it traverses its flight path. On contact, the energy and mass is concentrated to the projections, causing immediate penetration of the target by the front portion of the tip, with the remainder of the tip following. After impact, the radial grooves channel blood away from the tip as it penetrates the flesh of the target, allowing the arrow to completely travel through the target, achieving a "through and through" shot.

DETAILED DESCRIPTION

An aerodynamic tip for an archery arrow includes a nipple centered on the face of the point and surrounded by projections at the outer diameter. Air striking the rounded ends of the projections is diverted toward the rounded end of the nipple. As the air is diverted by the nipple it flows into radial grooves along the side of the body of the tip, where it passes into the atmosphere, minimizing air resistance encountered by the point as it traverses its flight path. On contact, the energy and mass is concentrated to the projections, causing immediate penetration of the target by the front portion of the tip, with the remainder of the tip following. After impact, the radial grooves channel blood away from the tip as it penetrates the flesh of the target, allowing the arrow to completely travel through the target, achieving a "through and through" shot.

Figure 1:
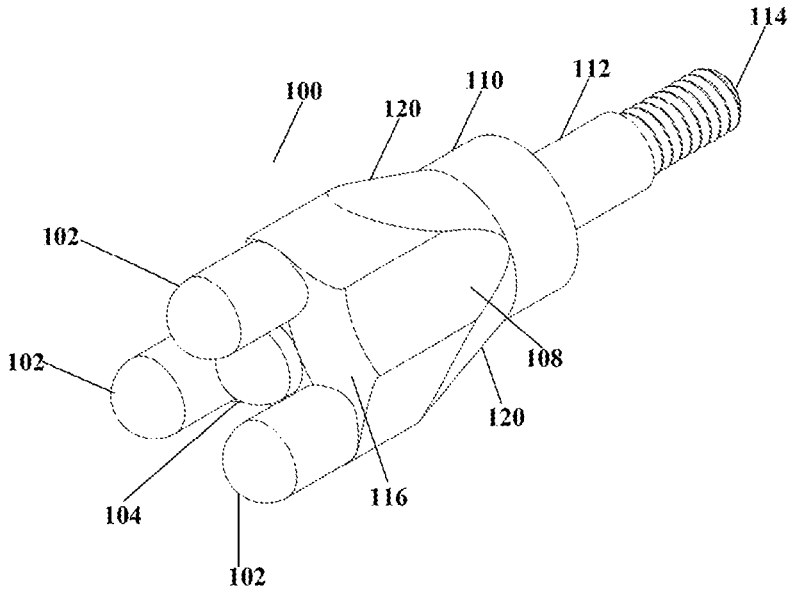
FIG. 1 provides a front isometric projection of a tip for archery arrows.

FIG. 1 shows a front isometric projection of a tip 100 for an archery arrow. The tip 100 includes a body 106 having an outer diameter. In embodiments, the body 106 may be of a diameter that minimizes both the mass of the tip and the surface area of the face of the tip in order to minimize air resistance and to maximize lift as the arrow traverses the flight path towards its target. These characteristics aside, the outer diameter of the body 106 is a matter of design choice.

Protruding from a distal face of the body 106 is a plurality of projections 102. In embodiments, each of the projections may be disposed at intervals along the outer diameter of the body 106 such that each projection 102 is equidistant from the projections 102 on either side of it. In embodiments, there may be three projections 102. However, other numbers of projections are possible. In embodiments, the projections may be disposed at, for example, 0°, 120° and 240° along the outer diameter of the body 106. In embodiments, the distal end of each projection 102 may have a curved surface.

In embodiments, a central nipple 104 may be disposed at the center of the distal face of the body 106, such that the central nipple 104 is disposed exactly at the center of the region of the distal face of the body 106 encompassed by the projections 102. In embodiments, the distal end of the central nipple 104 may have a curved surface.

In embodiments, the projections 102 and the central nipple 104 may be continuous with the body 106, such that the tip 100 constitutes a single, integrated piece. While the projections 102 and the central nipple 16 both project outward from the distal face of the body 106, in embodiments, the projections 102 may all be of equal length, while the central nipple 104 may be shorter than the projections 102.

A plurality of shoulders 116 provides surfaces that slope downward and away from the bases of the projections 102 and the central nipple 104. In embodiments, each shoulder 116 may be continuous with a radial groove 108. In embodiments, each radial groove 108 provides a channel down the side of the body 106 that terminates at the base 110 of the tip 100. As shown in FIG. 1, each radial groove may be formed by ridges 118 at either side of each radial groove 108. As shown, each ridge 118 may terminate in a taper 120 that may be continuous with the base 110 of the tip 100. In embodiments, the shoulders 116 may be formed by the distal face of the piece 100 sloping downward to communicate with the radial grooves 108.

Figure 7:
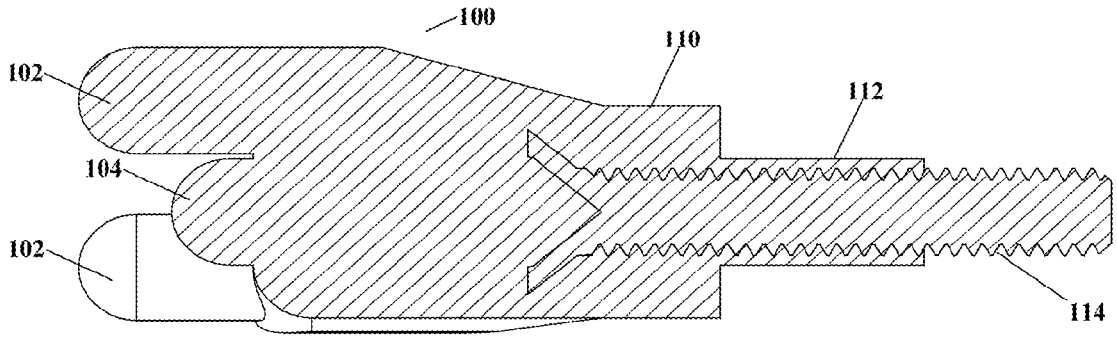
FIG. 7 provides a section view of the tip of FIG. 1.

In embodiments, the base 110 of the tip 100 may be continuous with a stem 112. In embodiments, the stem 112 may receive a tang 114 with which the tip 100 may be coupled with an arrow, as shown in FIG. 7. In embodiments, as in FIG. 7, the tang may be threaded, wherein the tang is received by a corresponding threaded receptacle in a shaft of an arrow. Other tangs may occur to those of ordinary skill and are completely within the scope of the present disclosure and the claims attached hereto.

In embodiments, the tip 100 may be fabricated from any of a number of elastomeric polymers. In embodiments, the tip 100 may be fabricated from either natural or synthetic rubber. In embodiments, the tip 100 may be fabricated from VITON (E.I. DU PONT DE NEMOURS AND COMPANY, Wilmington Del.). In embodiments, the tip 100 may be fabricated from an elastomer having a SHORE D durometer hardness of at least 90.

The tip 100 may be manufactured using conventional injection-molding techniques. An insert molding process may be used to produce a tip 100 with the tang 114 in a single process.

As described in the Background, conventionally dimensioned and shaped blunt tips are disadvantageous from a standpoint of aerodynamics because the relatively large service area of the flat front face increases air resistance encountered by the arrow as it traverses the flight path, which aggravates the loss of momentum experienced by any arrow during flight.

The presently-described tip remedies the defects of conventional blunt tips by providing an optimized aerodynamic profile. Referring again to FIG. 1, as an arrow equipped with a tip 100 travels along its flight path, the air in the path of the arrow is diverted by the curved ends of the projections 102 and down the side of the body 106 of the tip 100. Additionally, air striking the projections 102 is also directed by the curved ends of the projections 102 inward toward the central nipple 104. Due to the curved surface at the end of the central nipple 104, air, either diverted to the central nipple 104 from the outwardly-projecting points 102 or striking the central nipple 104 directly is also diverted in much the same way as air is diverted by the nose cone of an aircraft, thus minimizing aerodynamic resistance.

As air is diverted by the central nipple 104, it encounters the downwardly-sloping shoulders 116, whereupon it is directed by the shoulders 116 into the radial grooves 108. The air is travels along the radial grooves 108 and simply passes into the atmosphere as it exits the radial grooves 108 at the base 110 of the tip 100. Because the tip is engineered to offer minimum aerodynamic resistance, much more of the arrow's momentum may be preserved during flight, compared with an arrow equipped with a conventional blunt tip. In fact, the aerodynamic properties of the tip 100 approximate the aerodynamic properties of a field tip.

Additionally, the tip 100 provides significantly less mass, so that more lift is preserved as the arrow flies through the air.

After impact, the radial grooves 108 may additionally serve to channel blood away from the tip as it penetrates the flesh of the target, allowing the arrow to completely travel through the target, a so-called "through and through" shot that is ordinarily only achievable with the most expensive tips available in the marketplace.

Figure 2:
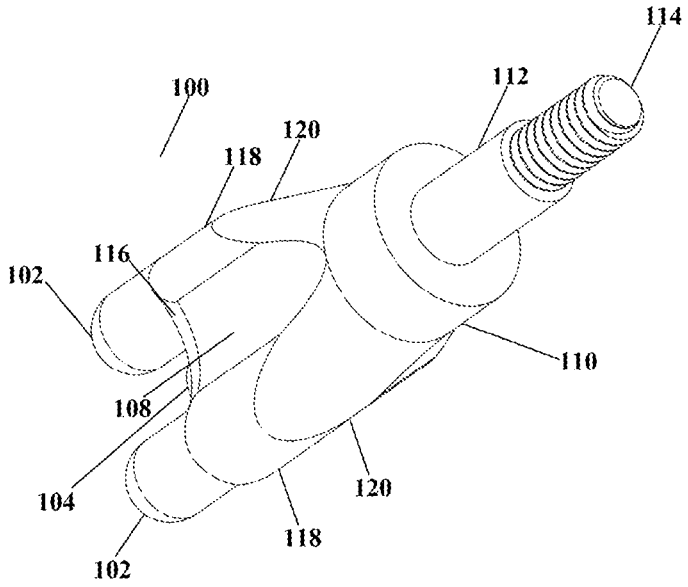
FIG. 2 provides a rear isometric projection of the tip of FIG. 1.

Turning now to FIG. 2, shown is a rear isometric projection of the tip 100. FIG. 2 provides an improved view of the shoulders 116, the radial grooves 108, the ridges 118 and the tapers 120.

Figure 3:
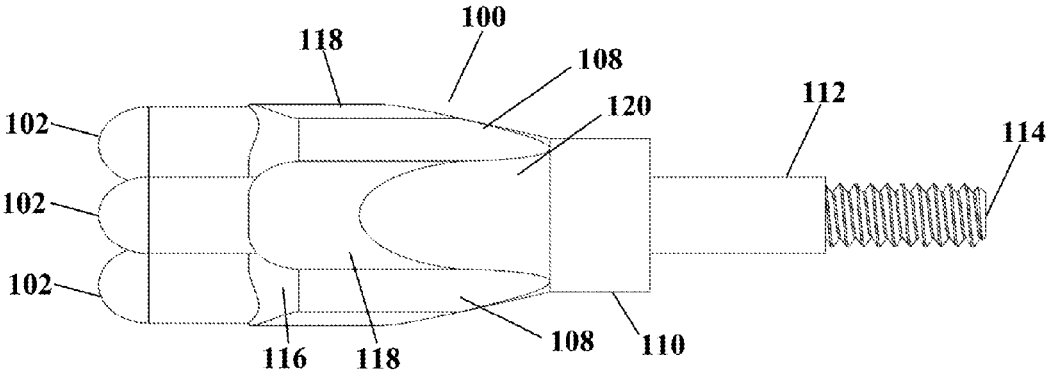
FIG. 3 provides a first side elevation of the tip of FIG. 1.
Figure 4:
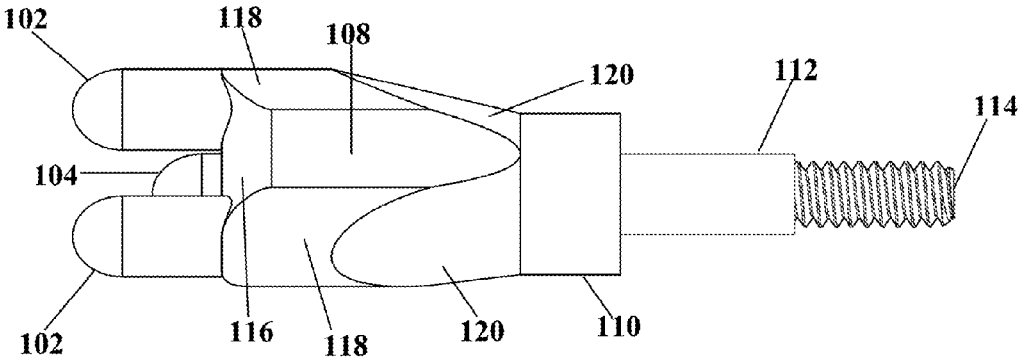
FIG. 4 provides a second side elevation of the tip of FIG. 1.
Figure 5:
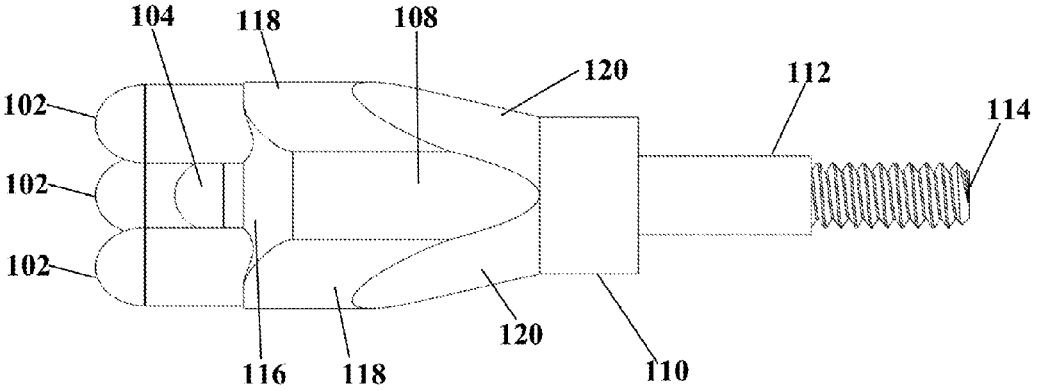
FIG. 5 provides a third side elevation of the tip of FIG. 1.

FIG. 3 shows a first side elevation of the tip 100. FIG. 4 shows a second side elevation of the tip 100, wherein the tip is rotated rearward 45° from the view of FIG. 3. FIG. 5 shows a third side elevation of the tip 100, wherein the tip 100 is rotated rearward 45° from the view of FIG. 4. The views of FIGS. 3-5 provide a clearer view of the structural relationship of the projections 102 to the central nipple 104 and their relative sizes.

Figure 6:
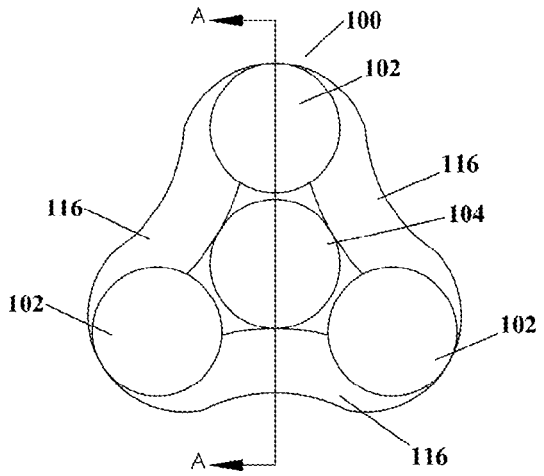
FIG. 6 provides a front elevation of the tip of FIG. 1.

FIG. 6 provides a front elevation of the tip 100, with section line A-A. FIG. 7 provides a rear section view of the tip 100 along section line A-A, shown in FIG. 6. FIG. 7 clearly shows the anchoring of the tang 114 within the body 106 of the tip 100.

Conventionally, archery tips are provided in different weights to accommodate personal preferences of individual archers. Typical weights are, for example 85 gr. (grains), 100 gr. and 125 gr. The presently-described tip may also be provided in a variety of sizes and weights, similar to the weights conventionally provided. Provision of the presently-described tip in different weights and sizes, however, has no effect on the geometry of the tip. The relative dimensions and structural relationships of the several components to each other remain the same regardless of the size and/or weight of the overall tip.

Figure 8:
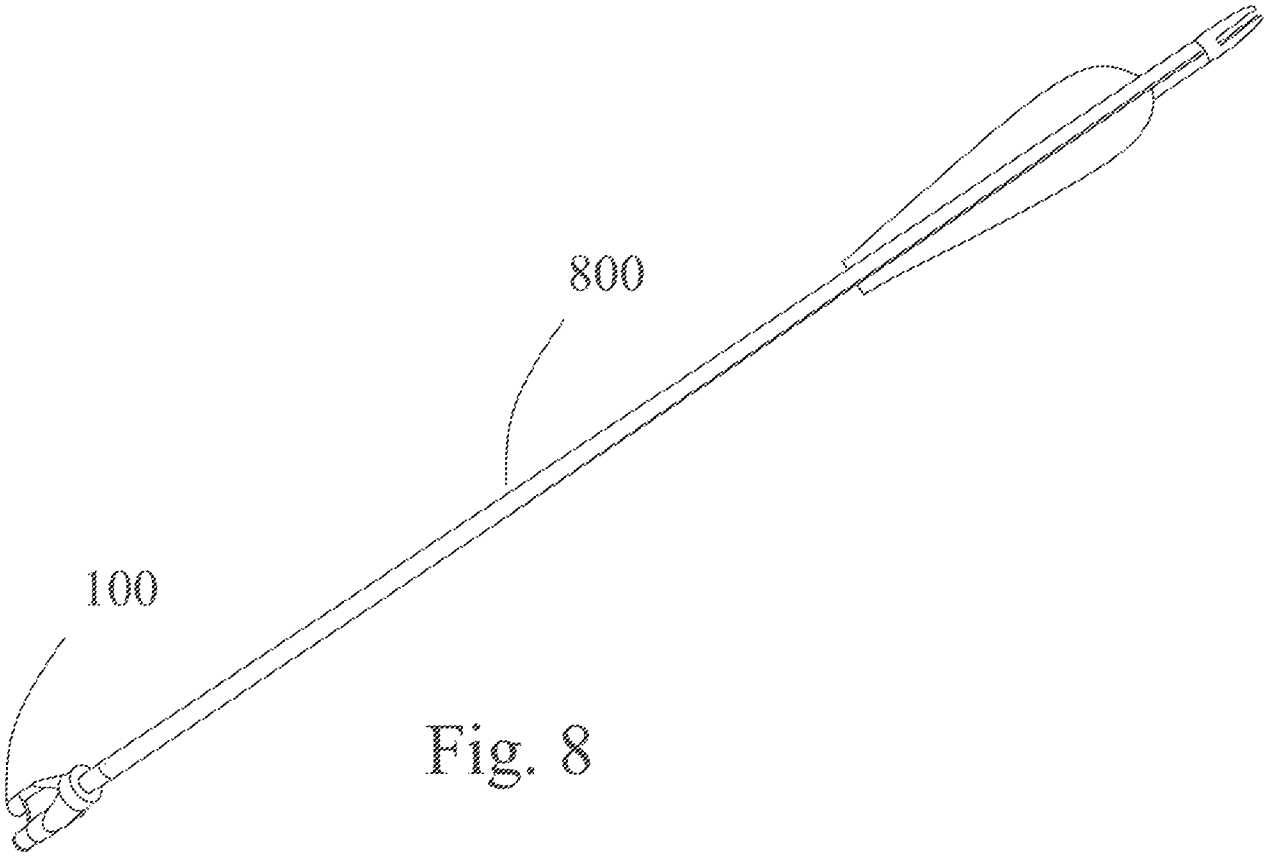
FIG. 8 provides a view of the tip of FIG. 1 coupled to a shaft to form an arrow.

FIG. 8 provides a view of the tip 100 deployed on a shaft 800 to form an arrow. In embodiments, the tip 100 may be coupled with the shaft 800 by screwing a threaded tang 114 into a corresponding threaded receptacle (not shown) provided in the shaft 800. In embodiments, the shaft 800 and the tip 100 may be provided in the form of a kit for assembly of an arrow.

In the foregoing specification, the present device has been described with reference to specific exemplary embodiments thereof. It will, however, be evident that various modifications and changes may be made thereto without departing from the broader spirit and scope set forth in the appended claims. The specification and drawings are, accordingly, to be regarded in an illustrative sense rather than a restrictive sense.

The invention claimed is:

1. A tip for an archery arrow comprising:

a body;

a plurality of projections continuous with a distal face of said body, each of said plurality of projections having a spherically-blunt distal end, each of said plurality of projections being disposed equidistant from each other along an outer diameter of said body;

a central nipple continuous with the distal face of said body and being situated at a center of the distal face of said body and being surrounded by said plurality of projections, said central nipple having a rounded distal end and having an axial dimension that is less than an axial dimension of said plurality of projections; and;

a radial groove between each pair of projections, said radial groove being disposed along a side of said body collinear with a long axis of said body.

2. The tip of claim 1, further comprising:

a base continuous with said body; and a stem continuous with one or both of said body and said base.

3. The tip of claim 1, wherein each of said radial grooves is formed by a pair of ridges in said body, each ridge being collinear with a long axis of said body.

4. The tip of claim 3, wherein each of said pair of ridges terminates in a taper that is continuous with a base of said body.

5. The tip of claim 1, wherein the distal face of said body forms a shoulder that slopes into said radial grooves for directing airflow into said radial grooves.

6. The tip of claim 1, further comprising a tang fixedly inserted into a stem integrated with said tip.

7. The tip of claim 6, wherein said tang is threaded for coupling said tip to an arrow by screwing said threaded tang into a corresponding threaded receptacle in a shaft of the arrow.

8. The tip of claim 1, wherein said tip is fabricated from an elastomer.

9. The tip of claim 8, wherein said elastomer comprises one of:

natural rubber; and synthetic rubber.

10. The tip of claim 8, wherein said elastomer comprises VITON.

11. The tip of claim 1, wherein said plurality of projections comprises at least three projections.

12. The tip of claim 11, wherein single ones of said plurality of projections are disposed at each of 0°, 120° and 240° along the outer diameter of said body.

13. An archery arrow comprising:

a shaft; and a tip for an archery arrow as described in claim 1; wherein said tip is removeably secured to said shaft at a distal end of said shaft.

14. A kit for assembling an archery arrow comprising;

a tip for an archery arrow as described in claim 1; and a shaft, wherein said shaft and said tip are removeably coupled to form an archery arrow.

* * * * *